United States Patent [19]

Chaney

[11] 4,083,317

[45] Apr. 11, 1978

[54] METHOD AND APPARATUS FOR BREAKING ICE WITH WATER

[75] Inventor: Preston E. Chaney, Dallas, Tex.

[73] Assignees: John E. Holder; Stanley R. Moore; Thomas L. Crisman, all of Dallas, Tex. ; part interest to each

[21] Appl. No.: 767,777

[22] Filed: Feb. 11, 1977

Related U.S. Application Data

[63] Continuation of Ser. No. 620,994, Oct. 9, 1975, abandoned.

[51] Int. Cl.[2] ..... B63B 35/08

[52] U.S. Cl. ..... 114/40

[58] Field of Search ..... 114/40–42; 299/24, 25; 61/1 R, 46, 103

[56] References Cited

U.S. PATENT DOCUMENTS

| | | | |
|---|---|---|---|
| 3,672,175 | 6/1972 | Mason | 114/41 |
| 3,678,873 | 7/1972 | Bennett | 114/42 |
| 3,693,360 | 9/1972 | Holder | 114/40 |

FOREIGN PATENT DOCUMENTS

| | | | |
|---|---|---|---|
| 20,536 of | 1901 | United Kingdom | 114/42 |

*Primary Examiner*—Trygve M. Blix
*Assistant Examiner*—Stuart M. Goldstein
*Attorney, Agent, or Firm*—Crisman & Moore

[57] ABSTRACT

Ice is broken with expenditure of less energy by pumping water from beneath the ice and discharging it in large quantities onto the surface of the ice. Breaking stress is provided by the weight of the water and by thermal shock. A conventional ice breaking apparatus can also be run up onto the ice to provide a breaking force in which case friction between the ice and the ice breaking apparatus is lessened by the water.

25 Claims, 6 Drawing Figures

METHOD AND APPARATUS FOR BREAKING ICE WITH WATER

This is a continuation of application Ser. No. 620,994, filed Oct. 9, 1975 and now abandoned.

BACKGROUND OF THE INVENTION

The invention relates to breaking ice, and more particularly to breaking ice by discharging substantial quantities of water onto the surface of the ice.

Since the discovery of petroleum in the Arctic regions of North America, efforts have begun to develop means for transporting the petroleum to processing and marketing areas in the more temperate climates. Two methods have been proposed; pipelines and tankers. At present only pipelines are being considered due to the difficulty of moving tankers through the ice that covers much of the Arctic oceans.

A notable effort to prove the feasibility of tankers for use in Arctic areas was made in the voyage in 1969 of the S.S. Manhattan through the Northwest Passage. *Arctic Oil and the S.S. Manhattan,* 2 UMR Journal 67, (1971). The Manhattan combined the principles of the tanker and the ice breaker in one vessel.

The conventional ice breaker concept is well-known. An ice breaker breaks ice by using two forces in combination. Initially, the ice breaker rams a sheet of ice, breaking what it can by the force of the impact. If the sheet remains, the ice breaker rides up onto the top of the sheet and breaks it by the downward force of its weight.

Some ice breakers use auxiliary means to assist them. Saws to cut grooves ahead of an ice breaker to weaken the ice are disclosed in U.S. Pat. No. 3,632,172 to Robinson; and explosives are utilized in U.S. Pat. No. 3,572,273 to Wood. Fluids are also used in several patents. U.S. Pat. No. 3,530,814 to Rastorguev et al discloses an ice breaker that includes a vibratory mechanism to impart vibrations into the ice and a washoff system through which water jets are directed to drive the submerged broken ice beyond the ice land to a safe distance. British Pat. No. 21,844 discloses an ice breaker equipped with steam heaters that direct heated water toward the bow propeller to assist in dissolving "frazil" ice. British Pat. No. 20,536 illustrates an ice breaker equipped with nozzles for discharging compressed air to remove snow from the path of the ship.

Conventional ice breakers, however, as evidenced by the experience of the Manhattan are not effective against the ice of the Arctic oceans. There are two significant problems. First, ice breakers are inefficient, only about 15% of the total energy expended being used to break ice. About 80% is lost to friction. The Manhattan attempted to alleviate this friction by using heat in the hull to provide a layer of water as lubrication. Second, ice breakers have poor manueverability due to the narrow path broken through the ice. If an ice breaker of the Manhattan type were to encounter unbreakable ice, its only choices would be to move backwards or to seek help from other ice breakers.

This is also a problem even before the ship encounters ice it cannot break. In heavy ice the ship may still be able to proceed slowly forward in a straight line, but cannot change course because the channel it cuts is too narrow.

SUMMARY OF THE INVENTION

In accordance with the invention, ice breaking is improved by pumping substantial quantities of water from below the ice and discharging it onto the surface of the ice. The water causes breakage by its weight and by thermal shock due to the difference in temperature between the water and the ice surface. The presence of the water on the ice also reduces friction.

The weight of the water can be concentrated onto a particular spot on the ice by discharging the water from a plurality of laterally-spaced points and discharging the water toward a point between the outermost discharge points.

Further stress can be created in the ice by oscillating the discharge of the water at the critical frequency of the ice, either by moving the point of discharge across the surface of the ice or by regulating the rate of discharge to any one point.

BRIEF DESCRIPTION OF THE DRAWINGS

The invention may be more fully understood by reading the detailed description in conjunction with the following drawings, wherein.

DESCRIPTION OF THE PREFERRED EMBODIMENTS

Figure 1:
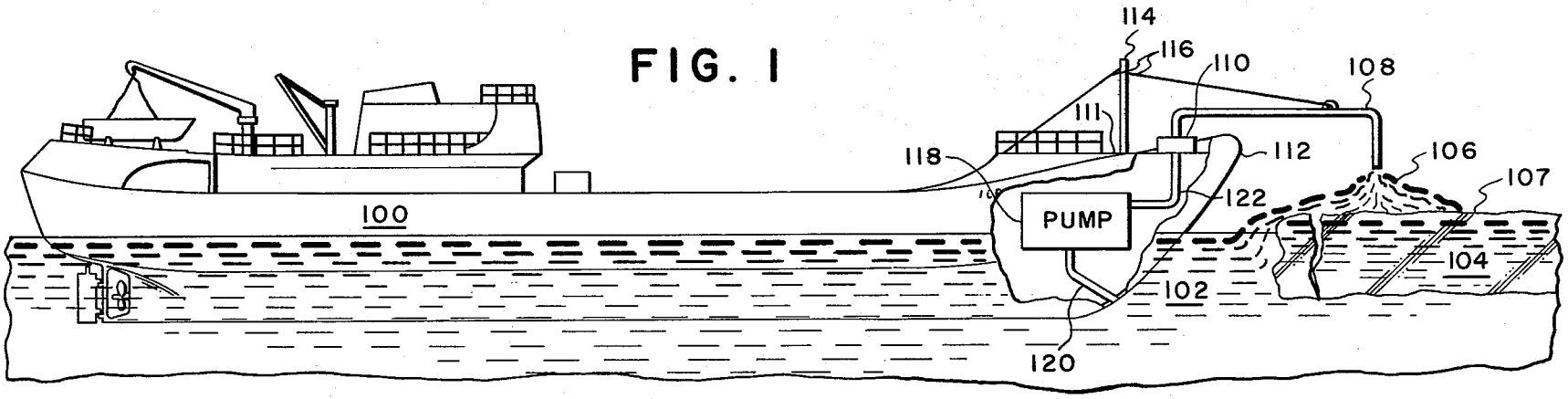
FIG. 1 is an elevational view showing the use of the invention in conjunction with a conventional ice breaking vessel.

Referring to FIG. 1, an ice breaker 100 is shown supported by a body of water 102 and breaking a channel through a sheet of ice 104. Water 106 is discharged in substantial quantities onto the surface 107 of the ice sheet 104 by a discharge conduit 108. The conduit is attached to the deck 111 of ice breaker 100 at a base 110 in its prow section 112. Conduit 108 extends forward of prow 112 to a point over the ice, preferably about 20 feet ahead of the prow. Conduit 108 may be supported by a standard 114 and cables 116. Water is supplied to a conduit 108 from body of water 102 by a pump 118 through an inlet conduit 120 and an extension 122 of conduit 108.

The water directly breaks the ice in two ways. First, it provides a substantial, heavy load on the ice. It is known that a 600 kilopounds (KIP) load over a moderate area will rupture sea ice 6 feet thick. It is also known that an impeller pump, of which pump 118 is preferably comprised, can deliver 880,000 pounds of water per minute per 1000 horsepower with a lift of 15 feet. The rate of water discharge onto the ice surface must be of this order of magnitude in thick ice because the water must be supplied faster than it can run off.

The maximum pumping rate is selected to provide best utilization of the total available ship horsepower. Of the ship's total horsepower, a part will be used for pumping the water while the remainder will be used on the screws to propel the ship. The primary objective is to move the ship through the ice at maximum speed with minimum damage. Therefore the pump capacity is chosen to provide the optimum distribution of power between pumps and screws to achieve this objective. In general the optimum pump horsepower will usually fall in the range of 5% to 25% of the total ship horsepower. The exact optimum varies with the ice thickness, surface temperature of the ice and with the size and hull design of the ship. In addition to the weight advantage, pumping large quantities of water onto the ice minimizes freezing of the water deposited on the top of the ice.

In addition to loading the ice with its weight, the water substantially raises the temperature of the surface of the ice, which causes the ice to crack by thermal shock. It is known that winter ice is at a temperature of about −20° F, while the sea water is about +29.5° F, a difference of approximately 50° F. It is also known that the coefficient of expansion and elastic properties of ice are such that a thick sheet will be thermally stressed about 23 pounds per square inch (psi) per degree F. This, a tensile strength of around 215 psi, a change of about 10° will exceed the strength of the ice and cause it to crack. Even if there is not enough temperature difference to crack the ice, this thermal stress will reduce the strength so that the weight of the water and the ice breaker can break it more easily.

The water also plays a secondary roll in breaking the ice. It is known that the coefficient of friction between ice and steel increases from 0.1 or less at 32° F. to 0.5 at −40° F. It can thus be seen that discharging water onto the ice provides an 80% decrease in friction. This allows the ice breaker to ride up onto the ice sheet much more easily.

It can thus be seen that the water makes three important contributions to breaking the ice: loading, thermal shock, and lubrication. These contributions vary somewhat under different operating conditions of the ice breaker.

When the ice breaker operates at high speeds, loading is least important since the water is not able to build up a concentrated load. Next in importance is thermal shock since it operates quickly, although it is also limited by the quantity of water discharged. Most important in this situation is lubrication since the ice breaker rides onto the ice sheet.

At medium speeds, loading remains least important, but thermal shock becomes most important since more time is available for the heat of the water to affect the ice.

At slow speeds, loading is most significant since the water has sufficient time to accumulate in a large concentration. Thermal shock also has sufficient time to operate although it is secondary. Lubrication is least important since the ice generally breaks under the weight of the water before the prow of the ice breaker can reach it. As may be seen, the invention thus coordinates three forces that break the ice equally efficiently under a variety of operating conditions. The combination of forces allows more effective use of the ship's power.

Figure 2A:
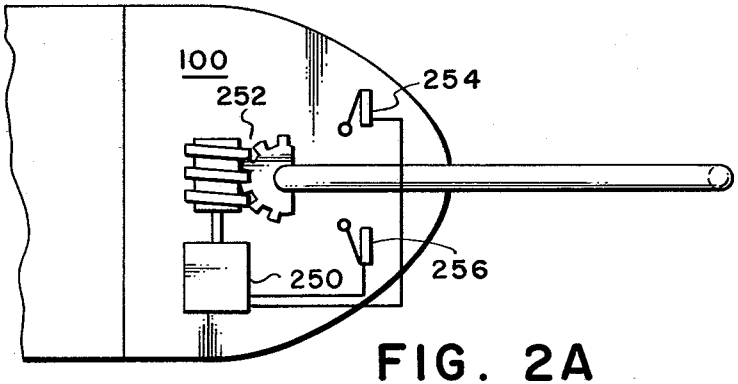
FIG. 2A is a plan view of an alternative apparatus for oscillating the conduit from side-to-side.
Figure 2:
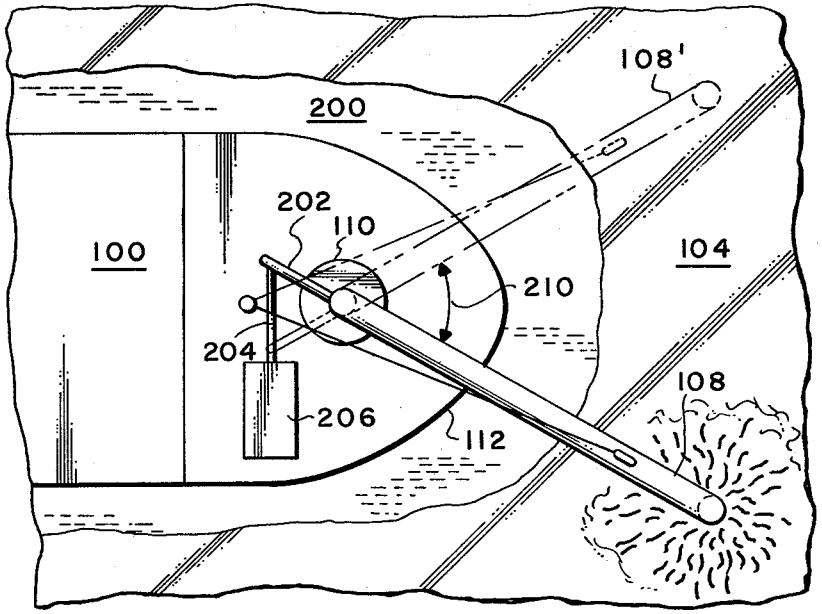
FIG. 2 is a plan view of the apparatus of FIG. 1 in which a movable conduit is used.

Referring to FIG. 2, ice breaker 100 is shown breaking a channel 200 through ice sheet 104. Discharge conduit 108 is shown in an alternative embodiment. The conduit is rotatably attached at its base 110 on the bow 112 of the ice breaker. Conduit 108 is connected through levers 202 and 204 to a reciprocating motive device 206, such as a hydraulic ram.

Linear motion of lever 204 in and out of ram 206 causes conduit 108 to swing back and forth from side to side of bow 112 across the ice, as indicated by arrow 210 and conduit 108 shown in phantom 108'. This motion accomplishes two things: first, it widens channel 200 to increase the manuverability of the ice breaker. Second, the oscillation of the conduit, i.e., its back and forth movement, can be regulated to the ice's critical frequency to assist in breaking. The critical frequency of ice has been found to be about 0.1 cycles per second, or less for ice greater than 36 inches thick and a water depth of 50 feet. At this frequency ice deflection and stress can be 2.5 times the static stress. The conduit therefore is oscillated at a frequency that has a period of 10 to 20 seconds under average conditions of water depth and ice thickness.

Referring to FIG. 2A, an alternative system for oscillating conduit 108 is shown. The conduit is caused to oscillate by a reversible motor 250 and a gear drive 252 comprising a worm and sector gear. Limit switches 254 and 256 initiate reversal of motor 250 at each end of the cycle. The period of oscillation is adjusted to ice resonance by varying the speed of the motor. The amplitude is adjusted by moving the limit switches.

Alternatively, the critical frequency of the ice can be reached by varying the discharge rate of the water from a stationary conduit as shown in FIG. 1. As a second alternative, the water may be alternately discharged from a two conduit system as will be described in FIG. 3. A damper valve 300 may be placed between conduits **308*a* and 308*b* above base 110, and it may be oscillated back and forth at the critical frequency as indicated by arrow 302 to alternately close each conduit. This causes the water 106 to be discharged first from conduit 308*a* and then conduit 308*b* then 308*a*** again, and so forth.

In either case, the effect is to substantially increase the stress on the ice and cause it to break with the discharge of less water and less force from the ice breaker.

Figure 3:
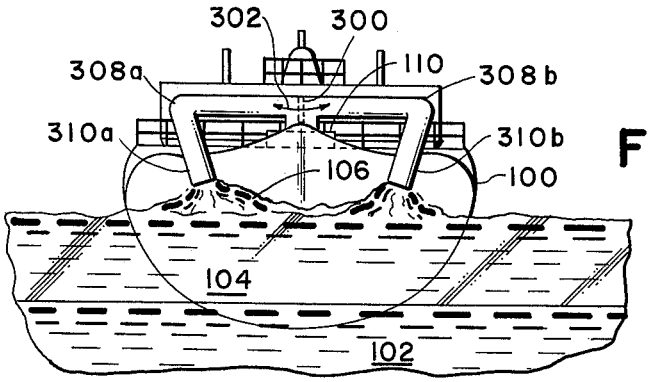
FIG. 3 is a front elevation of the apparatus of FIG. 1 in which multiple conduits are used.

Referring still to FIG. 3, a conduit arrangement for use on ice breaker 100 that maximizes water build-up while minimizing water run-off is shown. Ice breaker 100 is fitted at base 110 by two conduits **308*a* and 308*b*, diverging from each other and terminating at each side of prow 112. Each conduit has a downwardly and inwardly directed section 310*a* and 310*b*. By directing them inwardly, the force of water 106** from each conduit opposes the other, causing a buildup in the area between the two.

Figure 4:
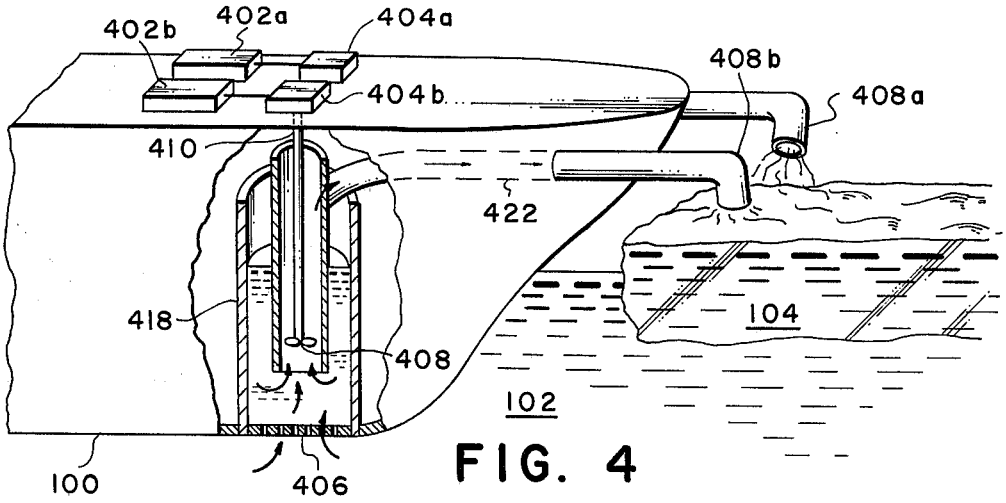
FIG. 4 is a perspective view of the pump and conduit system used in conjunction with an ice breaking vessel.

Referring to FIG. 4, the pump used for supplying water to the conduits is shown in greater detail. Pump 418 is preferably of the propeller type manufactured, for example, by Colt Industries of Kansas City, Kansas. Water enters pump 418 through a grate 406. This inlet point is preferably as far below the ice as practical since water temperature increases in the first 30 feet below the ice. The water is drawn through grate 406 by a impeller 408 which is powered through a shaft 410 and a reduction gear 404 by a prime mover, such as a diesel engine, 402. Impeller 408 pulls the water upwardly and forces it through conduit 422 and out nozzles **408*a* and 408*b*. As shown in the example, there may be two separate pump systems, one supplying nozzle 408*a* and one supplying 408*b***. It is preferable to have two or more discharges on opposite sides of the ship bow and to have the discharge directed inward so as to pile up the water to a maximum degree. The angle of discharge is preferably controlled for maximum load of water on the ice. This load is provided by the water's piling up between the discharge nozzles. This pile up is caused by the horizontal component of velocity of the water and the viscous drag of the water.

Figure 5:
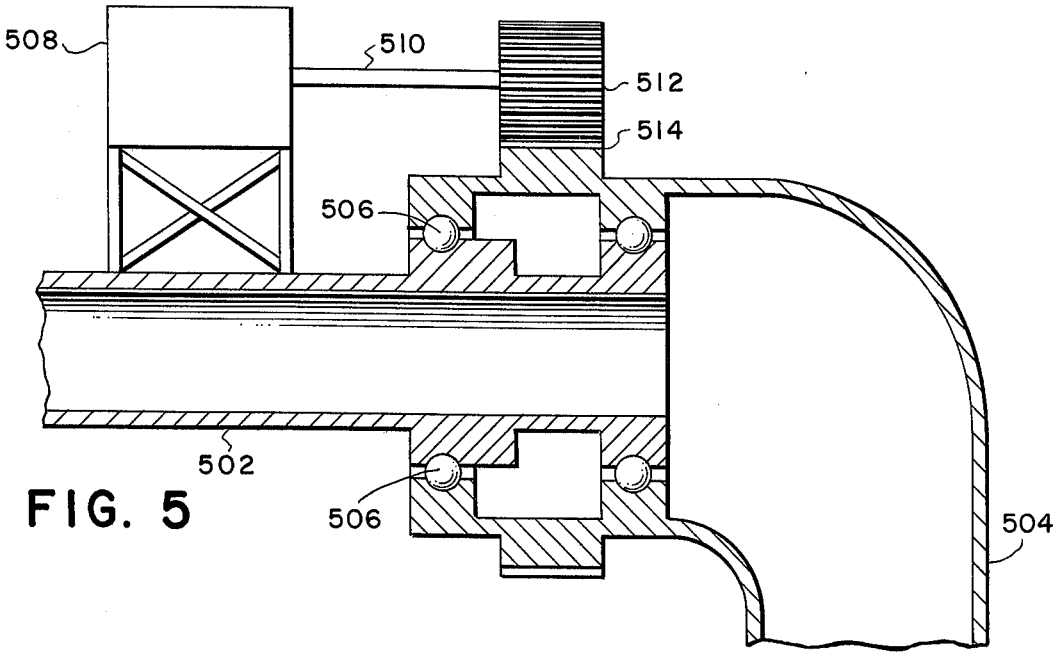
FIG. 5 is an elevation of a mechanism for controlling the angle of discharge of water from the conduit.

Referring to FIG. 5, a means is shown for controlling the angle of discharge of the water. The conduit is broken into two sections, a fixed section 502 and a rotatable section 504. These two sections may be secured together by a notch and flange arrangement and sealed by seals 506. The rotatable section 504 may be rotated by a motor and reduction gear 508 that is coupled through a shaft 510 and a pinion 512 and ring gear 514.

While particular embodiments of the invention have been shown and described, it is obvious that changes and modifications may be made therein without departing from the true scope and spirit of the invention. It is therefore the intention in the appended claims to cover all such changes and modifications.

What is claimed is:

1. A method of breaking ice covering a body of water adjacent a structure, comprising the steps of:

positioning a supply of water obtained from the body of water, on the structure above the ice; and discharging the supply of water through an unconstricted conduit onto the surface of the ice adjacent said structure at a sufficiently great volumetric rate for accumulating copious quantities of the water on the surface of the ice thus providing a heavy load thereon to thereby break the ice solely by the effect of the weight of the accumulated water and the thermal stress created within the ice by the water.

2. A method of breaking ice in accordance with claim 1 wherein the step of discharging said water further comprises oscillatorily varying the discharge of said water onto said ice.

3. A method of breaking ice in accordance with claim 2 wherein the step of varying the discharge of water comprises changing the rate of discharging said water onto said ice.

4. A method of breaking ice in accordance with claim 2 wherein the step of varying the discharge of water comprises changing the lateral position of discharging said water onto said ice.

5. A method of breaking ice in accordance with claim 1 further including the step of forcing said ice downwardly with a portion of the structure when said ice and said structure are brought into contact by relative motion between said ice and said structure.

6. A method of breaking ice in accordance with claim 2 wherein the step of varying the discharge of water comprises alternately discharging said water at two laterally spaced points on the surface of said ice.

7. A method of breaking a path through ice in a predetermined direction to permit the passage of a floating vessel, comprising the steps of:

pumping water from beneath the surface of the ice to a point above the surface of said ice; and discharging the water through an unconstricted conduit onto the surface of the ice adjacent the vessel at a sufficiently great volumetric rate for accumulating copious quantities of the water on the surface of the ice thus providing a heavy load thereon to thereby break the ice solely by the effect of the weight of the accumulated water and the thermal stress created within the ice by the water.

8. A method of breaking a path through ice in accordance with claim 7 wherein the step of discharging further comprises the steps of:

discharging at least two streams of water from different horizontal points on said vessel; and directing the streams inwardly onto said ice between the two points.

9. A method of breaking a path through ice in accordance with claim 7 further including the step of oscillating the discharge of water to coincide with the destructive resonant frequency of said ice.

10. A method of breaking a path through ice in accordance with claim 9 further including the step of running said vessel onto the surface of said ice to provide additional breaking force.

11. A method of breaking a path through ice in accordance with claim 9 wherein the step of oscillating comprises horizontally moving a single discharge stream back and forth across said ice.

12. A method of breaking a path through ice in accordance with claim 9 wherein the step of oscillating comprises alternating the flow from a multiplicity of discharge conduits laterally spaced across said ice.

13. A method of breaking a path through ice in accordance with claim 9 wherein the step of oscillating comprises varying the rate of discharging said water onto said ice.

14. Ice breaking apparatus for use with a floating vessel which is adapted to break ice covering a body of water, comprising:

means in the vessel for pumping water onto said vessel from said body of water and above the surface of the ice; and a conduit having an unconstricted discharge opening connected to the pumping means providing a low head on said pump for discharging the water onto the surface of said ice adjacent said vessel at a sufficiently great volumetric rate for accumulating copious quantities of the water on the surface of the ice thus providing a heavy load thereon to thereby break the ice solely by the effect of the weight of the accumulated water and the thermal stress created within the ice by the water.

15. Ice breaking apparatus in accordance with claim 14 wherein the discharge end of the conduit is laterally movable.

16. Ice breaking apparatus for use with a floating vessel which is adapted to break ice covering a body of water comprising:

means in the vessel for pumping water onto said vessel from said body of water and above the surface of the ice; and a plurality of laterally spaced conduits having unconstricted discharge openings connected to the pumping means and positioned to discharge the water at a point on said ice between the two outermost conduits at a sufficiently great volumetric rate for accumulating copious quantities of the water on the surface of the ice thus providing a heavy load thereon to thereby break the ice solely by the effect of the weight of the accumulated water and the thermal stress created within the ice by the water.

17. Ice breaking apparatus for use with a floating vessel which is adapted to break ice covering a body of water, comprising:

means in the vessel for pumping water onto said vessel from said body of water and above the surface of the ice;

a plurality of laterally spaced unconstricted conduits connected to the pumping means; and means for alternately discharging water from each unconstricted conduit in resonance with the resonantly destructive critical frequency of said ice at a sufficiently great volumetric rate for accumulating copious quantities of the water on the surface of the ice thus providing a heavy load thereon to thereby break the ice solely by the effect of the weight of the accumulated water and the thermal stress created within the ice by the water.

18. Apparatus for protecting an arctic structure located in a body of water from encroaching ice, comprising:

means for pumping water from said body of water beneath the structure; and conduit means having an unconstricted discharge opening connected to the pumping means for discharging the water onto the surface of the ice adjacent said structure at a sufficiently great volumetric rate for accumulating copious quantities of the water on the surface of the ice thus providing a heavy load thereon to thereby break the ice solely by the effect of the weight of the accumulated water and the thermal stress created within the ice by the water.

19. Apparatus for protecting an arctic structure in accordance with claim 18 further including means for oscillating the discharge of said water to coincide with the resonant frequency of said ice.

20. Apparatus for protecting an artic structure in accordance with claim 18 wherein the conduit means comprises means for discharging the water at a plurality of points onto the ice.

21. A water discharge system for breaking ice, comprising:

a pump;

an inlet conduit connected to the inlet of the pump and positioned to remove the water from beneath the ice; and an unconstricted outlet conduit connected to said pump having a laterally extending portion and a downwardly extending portion both of which provide an unrestricted discharge opening for discharging water onto the surface of the ice at a sufficiently great volumetric rate for accumulating copious quantities of the water on the surface of the ice, thus providing a heavy load thereon to thereby break the ice solely by the effect of the weight of the accumulated water and the thermal stress created within the ice by the water.

22. A water discharge system in accordance with claim 21 wherein the outlet conduit is rotatably attached to said pump.

23. A method of breaking ice with a ship, comprising the steps of:

pumping water from below the ice;

discharging the water through an unconstricted discharge outlet forward the bow of the ship at a sufficiently great volumetric rate for accumulating copious quantities of the water on the surface of the ice thus providing a heavy load thereon to thereby break the ice solely by the effect of the weight of the accumulated water and the thermal stress created within the ice by the water;

propelling said ship forward; and adjusting the relative horsepower used in the propelling and pumping steps to optimize forward speed of said ship.

* * * * *

UNITED STATES PATENT AND TRADEMARK OFFICE

CERTIFICATE OF CORRECTION

PATENT NO. : 4,083,317

DATED : April 11, 1978

INVENTOR(S) : Preston E. Chaney

It is certified that error appears in the above-identified patent and that said Letters Patent are hereby corrected as shown below:

On the Front Page, below the Abstract, where it is indicated that the patent contains "25 claims", it should read --23 claims--.

Signed and Sealed this

*Twenty-seventh* Day of *March 1979*

[SEAL]

*Attest:*

RUTH C. MASON
*Attesting Officer*

DONALD W. BANNER
*Commissioner of Patents and Trademarks*